US005893504A

United States Patent [19]

Baronian et al.

[11] Patent Number: 5,893,504

[45] Date of Patent: Apr. 13, 1999

[54] OPEN-ENDED BACKPACK FOR CARRYING A PLURALITY OF FOLDABLE CHAIRS

[76] Inventors: Lee Baronian, 500 Center Ave., Westwood, N.J. 07675; Peter Marzulli, 418 E. 78th St. #1C, New York, N.Y. 10021

[21] Appl. No.: 09/020,356

[22] Filed: Feb. 9, 1998

[51] Int. Cl.[6] ..... A45F 3/04

[52] U.S. Cl. ..... 224/656; 224/651; 224/644; 224/654; 224/627; 224/637; 383/61; 383/74; 383/78

[58] Field of Search ..... 224/153, 627, 224/637, 642, 644, 645, 650, 651, 652, 654, 655, 656, 659, 250; 383/61, 71, 72, 74, 78, 84, 117

[56] References Cited

U.S. PATENT DOCUMENTS

| | | | |
|---|---|---|---|
| 2,249,841 | 7/1941 | Loos et al. | 383/61 |
| 4,648,121 | 3/1987 | Lowe | 224/654 |
| 4,936,495 | 6/1990 | Van De Pol | 224/627 |
| 4,972,981 | 11/1990 | Gex | 224/645 |
| 5,288,150 | 2/1994 | Bearman | 383/117 |
| 5,570,829 | 11/1996 | Harrison | 224/651 |

FOREIGN PATENT DOCUMENTS

| | | | |
|---|---|---|---|
| 167038 | 4/1950 | Australia | 224/209 |
| 86119 | 4/1919 | Switzerland | 224/209 |
| 1045896 | 12/1958 | Switzerland | 383/61 |

*Primary Examiner*—Allen N. Shoap
*Assistant Examiner*—Gregory M. Vidovich
*Attorney, Agent, or Firm*—Richard A. Joel, Esq.

[57] ABSTRACT

A backpack for carrying foldable chairs and other accessories comprises an outer envelope open at one end into which a foldable chair is placed, a pair of spaced straps mounted at one end to the outer surface of the backpack and extending over the outwardly extending legs of the chair and being removably coupled to a mating strap attached to the mid point of the opposite outer surface of the backpack. The backpack further includes a first zippered compartment extending horizontally across the outer surface and including a mesh pocket mounted at an intermediate position thereon. A drawstring is mounted along each end of the envelope opening to secure the chair in place. The backpack also includes a reinforcing strap mounted horizontally to the surface at the upper end thereof and having one end of a pair of shoulder straps mounted thereto at an intermediate position and a handle mounted thereto at the upper portion of said reinforcing strap to be used with a second handle on the other side of the opening. The shoulder strap is connected at the other end to a mating member which is mounted to the base of the backpack. A waist strap extends from each of the shoulder straps and said waist straps are removably joined together about the user. The beach chair and accessories may be transported easily while at the same time freeing up one's hands for any number of tasks.

5 Claims, 2 Drawing Sheets

OPEN-ENDED BACKPACK FOR CARRYING A PLURALITY OF FOLDABLE CHAIRS

BACKGROUND OF THE INVENTION

This invention relates to a backpack and in particular to a backpack bag for carrying beach chairs and other accessories.

The prior art includes U.S. Pat. No. 5,004,134 to Barry which discloses a backpack system for personal use designed to carry a full day's worth of beach related items. The Barry design permits carrying a tubular type beach chair with the backpack but the design itself is incapable of carrying the conventional aluminum frame beach chair. U.S. Pat. No. 4,972,981 to Gez discloses a backpack for carrying folding chairs and a shoulder strap to allow the transport on the back of a user. The backpack design is opened at the end and includes a different means of securing a chair to the backpack.

Beachgoers and individuals who spend their time outdoors have too often been faced with the dilemma of toting their beach or lawn chairs which are cumbersome by nature. As a result, there have been a number of attempts by inventors to solve this very obvious problem of conveniently carrying a foldable chair.

Most attempts at a solution have been in the nature of combining a pack with a chair. For instance, U.S. Pat. No. 4,487,345 to Pierce, et al and U.S. Pat. No. 5,318,342 to Hale essentially present foldable chairs fashioned with shoulder straps and a pack on one side for carrying other items. The packs are obviously cumbersome and neglect those who already own chairs and would rather not spend the money on another chair or prefer to use the one they have.

U.S. Pat. No. 4,720,029 to Varinikis is by all accounts a chair (unfolded) that one straps to one's back. In the seating area, it is suggested that a rucksack can be affixed for carrying other items. Besides being rather ridiculous looking, this pack, extending awkwardly out from the user's back, is simply flawed in design. The crossbar at the base of the chair lies directly across the lower part of the wear's back in a most uncomfortable position. And finally, the consumer is forced to use the chair that is designed into the pack even if the consumer already owns a chair.

Taking the foregoing concept one step further, U.S. Pat. Nos. 5,289,958 to Jay, 5,318,342 to Hale and 4,487,345 to Pierce, et al, are essentially similar systems with the end result being a folded chair on one's back as opposed to the awkwardly hanging open chair described above. Still the same problems remain. The frame of the chair again lies across the user's back. Secondly, as above, the inventors fail to take into account those who already own chairs, who, in effect, are forced to put their chairs aside and use the chairs built into the prior art devices. Also, U.S. Pat. No. 5,298,958 proves to be rather complicated in the number of components involved.

A seemingly more efficient device is seen in U.S. Pat. No. 4,530,451 to Hamilton incorporating the same concepts as the above prior art patents. Again, one is offered a chair which this time clips to the pack, an obvious drawback being the danger of the chair popping off while wearing. More importantly, this is yet one more device that thrusts a chair upon the consumer that might not necessarily be to his liking or he might already own. Finally, this device is designed to carry only one chair.

U.S. Pat. No. 5,544,793 to Harrop takes a step towards accommodating those consumers that would prefer to carry their own chair to their ultimate destination. However, the set of straps employed is designed to fit one type of chair and does not provide any pouches or pockets or means whatsoever for carrying any other items. Though providing a pad for the slipcover that fits solely on the top of the chair, the device does nothing to protect one's lower back and buttocks on which the bottom half of the chair rests.

U.S. Pat. No. 5,570,829 to Harrison discloses a backpack with a compartment for a foldable beach chair. This device does not allow for a variety of chairs, nor is it padded against the back for the comfort of the user. One must fumble with four straps on the inside to secure the chair before zipping it up in its compartment. It also only fits one chair and what seems a very specific chair, the dimensions of which are provided in the specification, a serious drawback.

Applicant's design is an efficient and inexpensive means for carrying beach chairs and supplies within a pack which is opened at one end and within which the chair is secured. The backpack includes shoulder straps and a waist strap which hold the chair securely in position and permit carrying the pack in a secure manner. Drawstrings are also provided at the opening in the pack to further hold the chair in position.

The backpack of the present invention which is known by its name "Shorepac" is a new and innovative way of transporting beach chairs and other miscellaneous items and at the same time freeing up one's hands for other tasks such as tending to a child or carrying a cooler. The invention also facilitates biking or rollerblading to one's destination.

SUMMARY OF THE INVENTION

This invention relates to a backpack designed for carrying any number of a variety of beach chairs of different sizes and types comfortably and securely. The beach chair is positioned in a wide mouth opening in the backpack and is secured in place with straps which extend over the top of the pack and are mounted to mating buckles located in an intermediate position on the exterior of the pack envelope. The pack includes a pocket having a zippered opening extending horizontally across the exterior surface of the pack for carrying supplies and an exterior pocket mounted thereon having a mesh surface for carrying items which may be wet. More than one of a certain kind of chair can fit into the backpack in addition to other supplies such as towels, blankets, umbrellas, books, games, beach toys, laundry, groceries, etc.

The backpack includes a reinforcing strap extending horizontally thereacross having a pair of shoulder straps mounted thereto at one end and having connecting means to mount the straps to a pair of mating straps which are secured at one end to the base of the backpack on the other side. A waist strap is mounted to the shoulder straps to secure the backpack in place. The backpack also includes a foam pad extending vertically therealong adjacent the shoulder straps to cushion the load and a pair of handles extending upwardly from the upper surface to permit carrying of the backpack by hand. The open end of the backpack is secured to the chair by a pair of drawstrings which extends through the upper surface of the end of the backpack.

Accordingly, an object of this invention is to provide a new and improved backpack for carrying one or more beach chairs of various types and sizes.

Another object of this invention is to provide a new and improved backpack for securely carrying beach chairs and supplies, within a pack open at one end and having a predetermined number of pockets on the outer surface thereof.

A further object of this invention is to provide a lightweight backpack having an opening at one end to insert a beach chair adjustable straps for carrying the backpack and adjustable straps to secure a beach chair with the pack.

A more specific object of this invention is to provide a new and improved backpack/bag for carrying beach chairs and the like which includes an envelope open at one end and having drawstrings secured along the periphery of the open end thereof to tighten the opening about a beach chair, a pair of connecting straps extending over the open end to hold the beach chairs in position and straps to permit mounting the backpack on an individual's shoulders and about the individual's waist.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
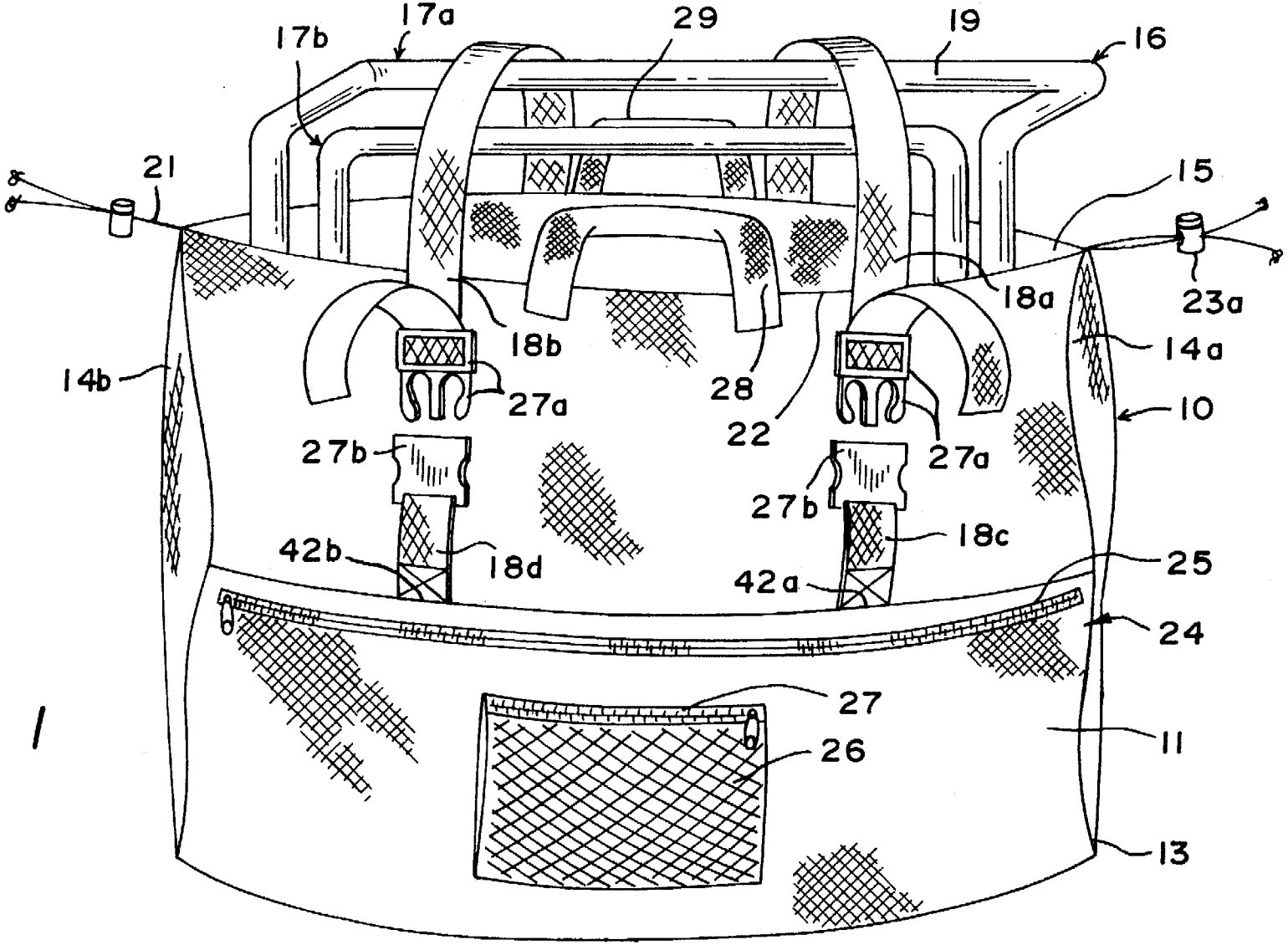
FIG. 1 is a front view of the backpack comprising the invention.
Figure 2:
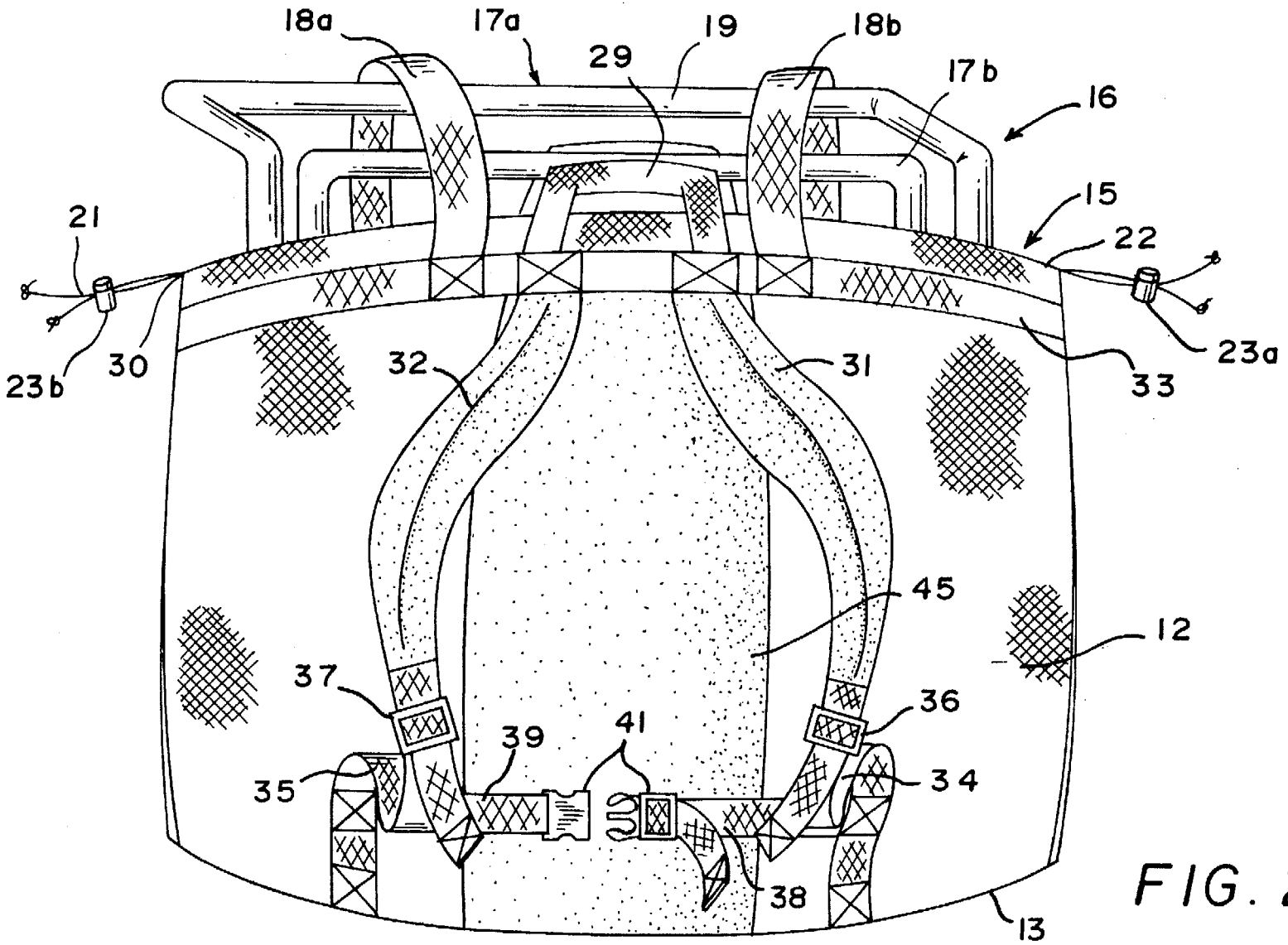
FIG. 2 is a rear view of the backpack comprising the invention.

Referring now to the drawings the backpack 10 comprises a front surface 11 and a rear surface 12 joined by a base 13 and flexible sides 14*a* and 14*b*. The pack 10 includes an opening 15 at its upper end forming an envelope within which a beach chair 16 may be mounted for transport. FIGS. 1 and 2 depict the chair legs 17*a* and 17*b* extending outwardly from the opening 15 and straps 18*a* and 18*b* extending over the rear horizontal leg portion 19 to secure the chair 16 in position within the backpack 10. A drawstring 21 extends within an aperture 30 along the upper edge 22 of the front and rear surfaces 11 and 12 to tighten the backpack 10 against chair legs 17*a* and 17*b* with the aid of locks 23*a* and 23*b*. In an alternate embodiment, a single drawstring lock may be used. The open ended mouth 15 lends itself to fitting a variety of items in the pack 10.

The front surface 11 includes a horizontal pocket 24 extending horizontally thereacross with a zipper 25 securing items within the pocket 24. Other beach accessories may be carried within the pocket 24 while a mesh pocket 26 with a zipper 27 is located on the outside of the pocket 24 to carry wet items. Additional supplies may be carried within the envelope opening 15 along with the chair 16.

The straps 18*c* and 18*d* are mounted at one end to the front surface 11 at a spaced intermediate point 42*a* and 42*b*. A mating pair of side release buckles 27*a* and 27*b* are mounted on the ends of straps 18*b* and 18*d* and straps 18*a* and 18*c*. The buckles 27*a* also include means for adjusting the straps 18*a* and 18*b* to secure the chair 16 tightly within the opening 15.

Handles 28 and 29 are mounted to the upper end of the front and rear surfaces 11 and 12 to facilitate carrying of a chairless backpack 10. The rear view of FIG. 2 depicts straps 31 and 32 which are mounted at one end to the horizontal reinforcing strap 33 and to the lower straps 34 and 35. The reinforcing strap 33 is affixed to the surface 12, a predetermined short distance from the edge 22. The lower straps are secured to the rear surface 12 and to straps 31 and 32 with the adjustable buckles 36 and 37. A waistband comprises a first strap 38 mounted to strap 34 and a second strap 39 mounted to strap 35 at a point where the straps 34 and 35 are mounted to the surface 12. This provides greater stability. Straps 38 and 39 mounted to the surface 12 are joined by side release buckle 41. A foam pad 45 extends vertically along the rear surface 12 to cushion the load on one's back.

The backpack 10 thus presents a compact efficient apparatus to carry items such as beach chairs 16 and supplies without the problems associated with prior art devices. A plurality of chairs 16 can be readily accommodated in the pack 10 while the padded interior provides greater comfort in carrying. The backpack 10 is inexpensive and extremely useful particularly for beachgoers, however, the pack 10 is also a combination hand carried bag, backpack, chair bag and is not limited to beach bag use.

While the invention has been explained by a detailed description of certain specific embodiments, it is understood that various modifications and substitutions can be made in any of them within the scope of the appended claims which are intended also to include equivalents of such embodiments.

What is claimed, is:

1. A backpack for carrying foldable chairs and other accessories comprises:

an outer envelope having a base, forward and rear surfaces extending outwardly from the base and sides joining said surfaces forming an opening at one end into which a chair is adapted to be placed and extend outwardly therefrom;

a first pair of spaced straps mounted at one end to the rear surface outer envelope and having a side release buckle on the other end of the strap;

a second pair of spaced straps mounted at one end to the forward surface of the envelope, each of said straps having a mating buckle to lock the side release buckles with the first pair of straps extending over the open end of the envelope to hold a chair in position within the envelope;

a drawstring mounted within the forward and rear surfaces at the envelope opening and extending outwardly therefrom and a lock engaging the extending drawstring to tighten the opening about the chair;

a reinforcing band extending transversely across the rear surface adjacent the opening and having the first pair of straps attached thereto;

a third pair of spaced carrying straps mounted to the reinforcing band at one end and having adjustable buckles at the other end;

a fourth pair of spaced straps mounted to the lower portion of the envelope at one end and connecting to the adjustable buckles at the other end for carrying purposes;

a pair of cross-straps each mounted at one end to one of the respective fourth pair of straps for additional stability;

a zippered compartment extending transversely across the front surface of the envelope for storage purposes; and, a mesh pouch located on the front surface to store wet items.

2. A backpack for carrying foldable chairs and other accessories in accordance with claim 1 further including:

a handle extending upwardly from the front and rear surfaces adjacent to the envelope opening for carrying purposes.

3. A backpack for carrying foldable chairs and other accessories in accordance with claim 2 wherein:

the first and second mating buckles are adjustable.

4. A backpack for carrying foldable chairs and other accessories in accordance with claim 3 further including:

a second lock attached to the drawstring at the other end of the envelope to further tighten the opening.

5. A backpack for carrying foldable chairs and other accessories in accordance with claim 4 further including a foam pad vertically connected to the rear surface of the outer envelope.

* * * * *